US012337221B1

(12) United States Patent
Barnes

(10) Patent No.: US 12,337,221 B1
(45) Date of Patent: Jun. 24, 2025

(54) LEG GUARD MOUNT GARMENT

(71) Applicant: James Bradley Barnes, Vestavia Hills, AL (US)

(72) Inventor: James Bradley Barnes, Vestavia Hills, AL (US)

(73) Assignee: Ballers Flex Gear LLC, Vestavia Hills, AL (US)

( * ) Notice: Subject to any disclaimer, the term of this patent is extended or adjusted under 35 U.S.C. 154(b) by 0 days.

(21) Appl. No.: 18/591,291

(22) Filed: Feb. 29, 2024

(51) Int. Cl.
*A63B 71/12* (2006.01)
*A63B 69/00* (2006.01)
*A41D 13/06* (2006.01)

(52) U.S. Cl.
CPC ... *A63B 69/0002* (2013.01); *A63B 2069/0011* (2013.01)

(58) Field of Classification Search
CPC ..... A63B 69/0002; A63B 2069/0011
See application file for complete search history.

(56) References Cited

U.S. PATENT DOCUMENTS 539,872 A * 5/1895 Kheiralla ..... A63B 22/001 482/51
1,580,453 A * 4/1926 Stentiford ..... A41D 17/00 2/46
2,982,968 A * 5/1961 Groot ..... A63B 71/1225 2/22
3,411,500 A * 11/1968 Gatts ..... A63B 21/4009 600/20
3,797,483 A * 3/1974 Feldman ..... A61H 1/0218 128/DIG. 15
4,252,112 A * 2/1981 Joyce ..... A61F 5/0104 602/26
4,761,834 A * 8/1988 Kolb ..... A41D 13/0506 2/338
5,131,490 A * 7/1992 Bell ..... A62B 1/02 182/7
5,375,262 A * 12/1994 Carter ..... A41D 17/02 2/22
5,393,303 A * 2/1995 Shiono ..... A61F 5/0111 602/23
5,490,826 A * 2/1996 Rose ..... A63B 21/00043 482/124
5,662,594 A * 9/1997 Rosenblatt ..... A61F 5/013 2/2.5
5,732,411 A * 3/1998 Coleman ..... A63B 71/1225 2/24
5,911,310 A * 6/1999 Bridgers ..... A63B 71/1225 2/22
6,272,682 B1 * 8/2001 Fullum ..... A63B 71/1225 2/22

(Continued)

*Primary Examiner* — Robert H Muromoto, Jr.
(74) *Attorney, Agent, or Firm* — Dunlap Bennett & Ludwig, PLLC; Anna L. Kinney

(57) ABSTRACT

A wearable lower body garment for efficiently attaching and removing athletic padding, or in the alternative for enabling continuous wear of athletic padding. The lower body garment is made of durable and flexible material to allow a user freedom of movement. The lower body garment is worn as a pant-like garment that includes both flexible and adjustable straps to conform to a user's shape. The lower body garment has anchor points disposed on the outer leg portion and on the inseam that allow for attachment of athletic padding.

5 Claims, 3 Drawing Sheets

(56) References Cited

U.S. PATENT DOCUMENTS 6,347,403 B1 * 2/2002 Wilcox ..... A41D 13/065 2/24
6,393,610 B1 * 5/2002 Parks ..... A63B 71/1225 2/22
6,427,239 B1 * 8/2002 Worden ..... A41D 13/065 2/24
6,490,733 B1 * 12/2002 Casaubon ..... A41D 13/0007 2/81
6,519,775 B1 * 2/2003 Garcia ..... A41D 13/0543 2/22
7,089,598 B2 * 8/2006 Sallas ..... A41D 13/065 2/79
7,341,025 B1 * 3/2008 Streeter ..... A47D 13/046 119/857
7,945,968 B2 * 5/2011 Johnson ..... A41D 13/065 2/23
7,988,652 B2 * 8/2011 Chao ..... A61F 5/0125 24/522
8,302,212 B1 * 11/2012 Wiens ..... A41D 1/088 2/24
9,427,032 B2 * 8/2016 Robinson ..... A41D 27/02
9,616,315 B2 * 4/2017 Smith ..... A41D 13/0568
9,656,149 B2 * 5/2017 Hughes ..... A41D 13/015
10,188,926 B2 * 1/2019 O'Malley ..... A63B 69/26
10,231,496 B1 * 3/2019 Glassner ..... A41D 1/06
10,993,485 B2 * 5/2021 Kühl ..... A41D 1/06
D923,916 S * 7/2021 Warren, Jr. ..... D2/743
11,291,878 B2 * 4/2022 Carosella ..... A63B 23/04
11,452,319 B1 * 9/2022 Buonincontro .... A41D 13/0543
12,181,253 B2 * 12/2024 Roby ..... A41D 13/0512
2001/0047904 A1 * 12/2001 Antonio ..... A45F 3/14 182/6
2003/0000987 A1 * 1/2003 Barr ..... A45C 7/009 224/684
2003/0005505 A1 * 1/2003 DeMott ..... A41D 13/0581 2/23
2005/0072825 A1 * 4/2005 Barr ..... A45F 3/00 224/675
2005/0081274 A1 * 4/2005 Vorhis ..... A41D 13/065 2/24
2005/0148918 A1 * 7/2005 Nathanson ..... A61F 5/0123 602/27
2005/0182346 A1 * 8/2005 Cole ..... A61F 5/0102 602/28
2005/0192159 A1 * 9/2005 Jackson ..... A45F 3/14 482/23
2008/0085817 A1 * 4/2008 Brentlinger ..... A63B 31/00 482/55
2008/0185412 A1 * 8/2008 Hollins ..... A45F 5/02 224/660
2008/0280737 A1 * 11/2008 Cook ..... A63B 21/065 482/105
2008/0282442 A1 * 11/2008 Bauvois ..... A62B 35/0006 2/227
2009/0144873 A1 * 6/2009 Jewell ..... A61F 5/0125 2/24
2011/0072545 A1 * 3/2011 Bennett ..... A41D 13/0543 2/229
2012/0158041 A1 * 6/2012 Craig ..... A61B 17/1322 2/2.5
2012/0330203 A1 * 12/2012 Jones ..... A61F 5/0123 602/16
2013/0023843 A1 * 1/2013 Chen ..... A61F 5/449 604/327
2013/0059704 A1 * 3/2013 McCants ..... A63B 69/0071 482/131
2013/0061365 A1 * 3/2013 Arceo ..... A41D 13/0568 2/24
2013/0191956 A1 * 8/2013 Elliott ..... A41D 13/0543 2/46
2014/0215678 A1 * 8/2014 Greenbaum ..... A41D 13/0543 2/22
2014/0237696 A1 * 8/2014 Carver ..... A41D 13/08 2/24
2015/0328033 A1 * 11/2015 Ingimundarson ..... A61F 5/0193 602/23
2016/0095362 A1 * 4/2016 Alomar, Jr. ..... A41D 13/065 2/22
2017/0095723 A1 * 4/2017 Sushko ..... A63B 71/1225
2017/0188641 A1 * 7/2017 Bell ..... A41D 13/0568
2017/0340941 A1 * 11/2017 Campione ..... A63B 69/0059
2018/0116852 A1 * 5/2018 Petursson ..... A61F 5/0123
2018/0292175 A1 * 10/2018 Roby ..... A41D 13/065
2020/0187575 A1 * 6/2020 Hollis ..... A41D 13/0568
2021/0228958 A1 * 7/2021 Newell ..... A63B 69/0002
2022/0061436 A1 * 3/2022 Muturi ..... A61F 2/60
2022/0226715 A1 * 7/2022 Gauvin ..... A41D 13/0543
2024/0016242 A1 * 1/2024 Garcia ..... A41D 13/065
2024/0099400 A1 * 3/2024 Lombardi ..... A41D 13/065

* cited by examiner

LEG GUARD MOUNT GARMENT

BACKGROUND OF THE INVENTION

The present invention relates to athletic padding and, more particularly, to a leg guard mount garment.

Traditionally, catchers in both baseball and softball wear protective padding to cover aspects of their bodies, which include: a helmet with faceguard, chest protector, and shin/knee guards. The helmet and chest protector require very little time to put on, but the shin/knee guards require a significant amount of time. Shin guards may even involve help from additional people (e.g., players, coaches and/or adults) to secure them on the catcher. The delays associated with putting on shin/knee guards can delay a pitcher's warmup. These inefficiencies are exacerbated when the catcher needs to gear-up between innings, after being the last out at-bat, or being left on-base when the last out of an inning is made. As can be seen, there is a need for a wearable garment that lessens the resources required for putting on shin/knee guards and also speed up the pace of game/playing time.

SUMMARY OF THE INVENTION

In one aspect of the present invention, a lower body garment for efficiently attaching/removing padding is disclosed. The lower body garment includes an attachment structure with a belt and a buckle, wherein the belt is adapted to suspend the attachment from the waist of a user. A plurality of outer garment straps and inner garment straps are sewn, or otherwise affixed at a proximal end to the belt. When worn the outer garment straps extend along the outer aspect of each of the user's legs, whereas the inner garment straps extend along each inseam of the user's legs. Each inner and outer strap includes a plurality of openings/holes spaced along the length of the strap whereby a leg guard/pad can be attached or removed to the holes. A plurality of adjustable straps are attached, or sewn, on one side between a pair of inner and outer garment straps. Each inner and outer garment strap pair also includes at least one flexible strap that is affixed, or sewn, on both sides. Finally, a plurality of leg pads is removably securable to the attachment structure.

These and other features, aspects, and advantages of the present invention will become better understood with reference to the following drawings, description, and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is a lower body garment that allows for quick and efficient attachment and removal of shin and/or leg guards, or in the alternative provides comfort such that a user can wear shin guards continuously during a game without the need to remove them. The garment bears similarities to chaps.

Figure 1:
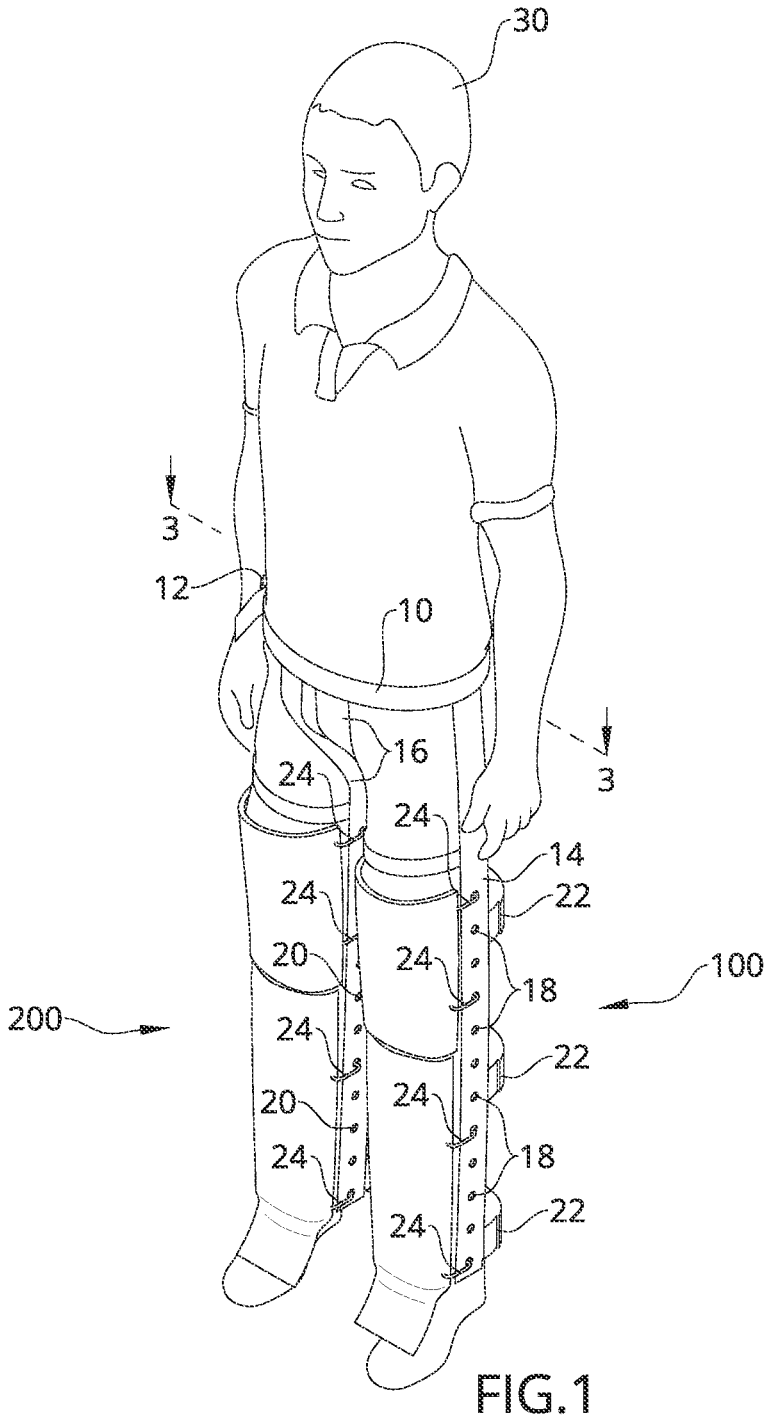
FIG. 1 is a perspective view of a leg guard attachment garment according to an embodiment of the present invention, shown in use.
Figure 2:
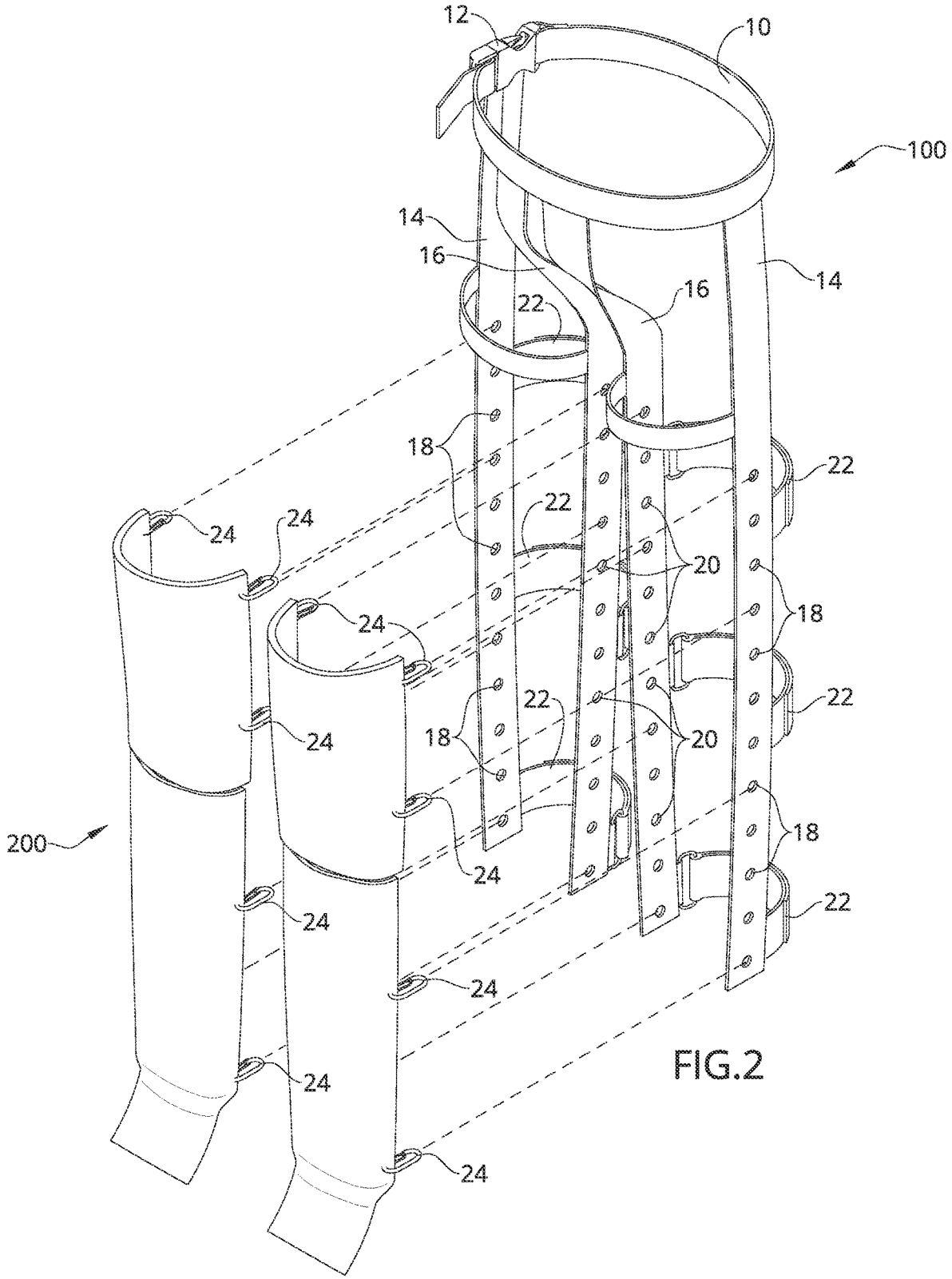
FIG. 2 is an exploded view thereof.
Figure 3:
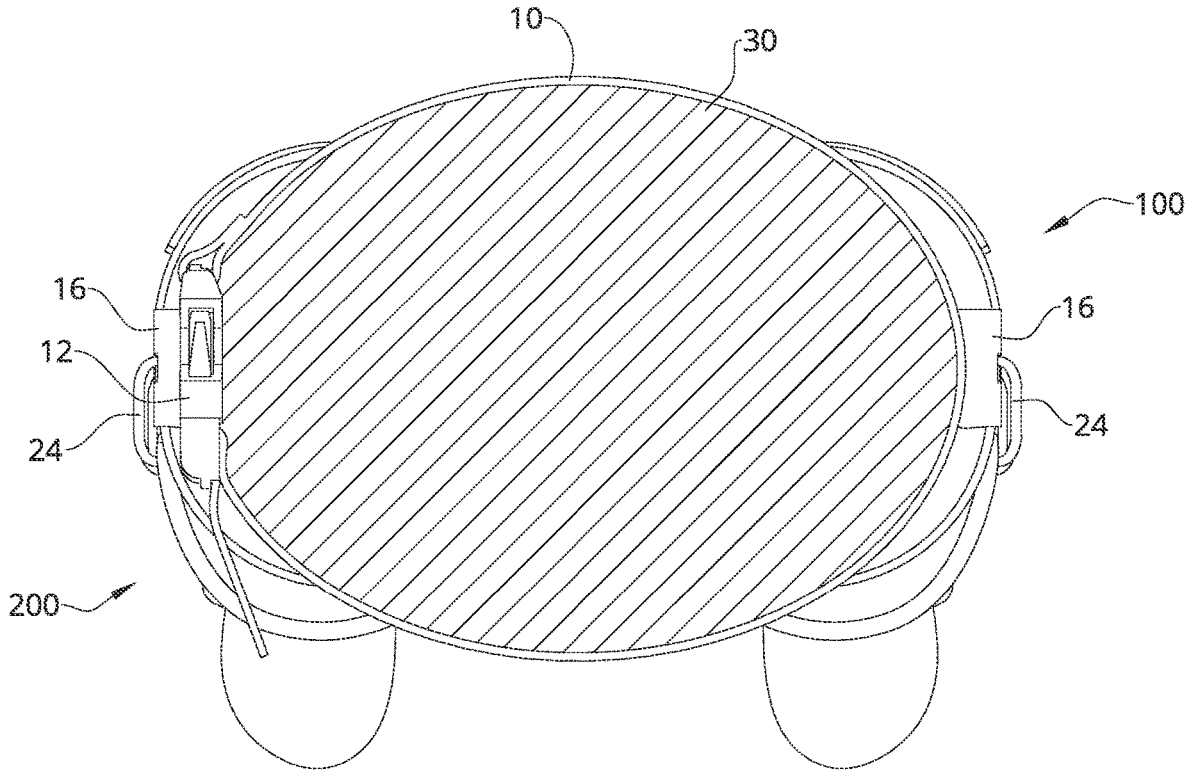
FIG. 3 is a sectional view thereof, taken along line 3-3 in FIG. 1.

Referring to FIGS. 1-3, FIG. 1 illustrates a perspective view of the inventive lower body garment 100 worn by a user 30, with leg guards 200 or pads attached. A user 30 can secure the garment 100 to their waist by clamping buckle 12 attached to belt 10, notably the belt can be worn circumferentially around the user's 30 waist. The garment 100 comprises outer attachment straps 14 and inner attachment straps 16. The attachment or foundation straps 14, 16 may be provided in a pair for each of the user's legs, such that the outer attachment straps 14 are adapted to be worn vertically along the outer aspect of a user's 30 leg, whereas the inner attachment straps 16 are adapted to be worn vertically along the user's 30 inseam. In a preferred embodiment, a plurality of outer holes 18 can be disposed along the outer attachment straps 14, and a plurality of inner holes 20 can be disposed along the inner attachment straps 16. The garment 100 can be secured to user's 30 legs by an elastic strap, which can be affixed to the outer attachment strap 14 and the inner attachment strap 16 and adapted to be worn across the front of the user's 30 thigh alone or in conjunction with adjustable straps 22 which can be installed horizontally on the strap pair 14, 16, wherein each strap 22 can be worn across the back of a user's 30 thigh, a back of the user's 30 calf, or a back of the user's 30 lower leg proximate to the ankle. The pads 200 may have clips 24 which can be used to removably attach the pads 200 to the garment 100 via holes 18, 20. In some embodiments, the straps 22 may be fixable and secured to the outer attachment strap 14 and removably fastened to the inner attachment strap 16 on each leg.

FIG. 2 illustrates an exploded view of inventive lower body garment. FIG. 2 illustrates the elements in FIG. 1 with the following additional details. The clasping mechanism 12 of the belt 10 is shown in further detail, however, it is envisioned that any known mechanism for securing a belt 12 is contemplated by the current invention, such as a buckle. The pads 200 can be detached from garment 100, as shown in FIG. 2. Adjustable straps 22 are shown in further detail. The adjustable straps 22 may have a surface with a hook closure portion and a loop closure portion, e.g., Velcro®, spaced from the hook portion one of the attachment straps 14, 16 may have a ring or slot through which one of the straps 22 may be fed, folded back onto itself, and secured by coupling the hook closure portion to the loop closure portion. It is understood that any known mechanism for securing and adjusting an adjustable strap 22 is contemplated by the present invention.

FIG. 3 illustrates a top-down sectional view of the garment 100. FIG. 3 more clearly illustrates the belt 10 secured circumferentially around a user's 30 waist using the clasping mechanism 12. The pads 200 are shown removably affixed to the attachment straps 14, 16 using clips 24.

It should be understood, of course, that the foregoing relates to exemplary embodiments of the invention and that modifications may be made without departing from the spirit and scope of the invention as set forth in the following claims.

What is claimed is:

1. A lower body garment comprising:

a belt with a buckle, wherein the belt is operative to suspend the lower body garment from a waist of a user;

foundation straps having longitudinally spaced apertures formed therein, a proximal end of each of the foundation straps being joined to said belt, wherein a first pair of the foundation straps are adapted to extend longitudinally along a first leg of the user with the first leg positioned between the first pair, a second pair of the foundation straps are adapted to extend longitudinally along a second leg of the user with the second leg positioned between the second pair, and wherein the longitudinally spaced apertures are configured to accommodate a set of complementary, correlating fasteners on the surface of a set of leg pads fasteners aligned along an axis perpendicular to the foundation straps;

at least one first adjustable strap adapted to extend across a rear of the first leg, thereby fastening the first pair to the first leg; and at least one second adjustable strap adapted to extend across a rear of the second leg, thereby fastening the second pair to the second leg.

2. The lower body garment of claim 1, wherein the fasteners are clasps.

3. The lower body garment of claim 1, further comprising a first elastic strap and a second elastic strap, each configured to lie across a front portion of a thigh the user, the first elastic strap joined to the first pair, and the second elastic strap joined to the second pair.

4. The lower body garment of claim 1, wherein the at least one first adjustable strap has a first end joined to an outer strap of the first pair, extends through a loop joined to an inner strap of the first pair, and fastens to itself; and the at least one second adjustable strap has a first end joined to an outer strap of the second pair, extends through a loop joined to an inner strap of the second pair, and fastens to itself.

5. The lower body garment of claim 1, wherein the at least one first adjustable strap and the at least one second adjustable strap both include an ankle level strap, a knee level strap, and a thigh level strap.

* * * * *